United States Patent [19]

Heinz et al.

[11] Patent Number: 4,896,842

[45] Date of Patent: Jan. 30, 1990

[54] PACKAGING MACHINE, ESPECIALLY FOR CIGARETTES

[75] Inventors: Focke Heinz, Verden; Jürgen Wach, Bremen, both of Fed. Rep. of Germany

[73] Assignee: Focke & Co. (GmbH & Co.), Verden, Fed. Rep. of Germany

[21] Appl. No.: 210,431

[22] Filed: Jun. 23, 1988

[30] Foreign Application Priority Data

Jun. 26, 1987 [DE] Fed. Rep. of Germany ..... 3721091

[51] Int. Cl.[4] ..... B65H 19/12

[52] U.S. Cl. ..... 242/58.6

[58] Field of Search ..... 242/58, 58.2, 58.6, 242/79, 58.1, 58.3, 58.4; 414/225, 744.6, 911

[56] References Cited

U.S. PATENT DOCUMENTS 4,744,711 5/1988 Heitmann et al. ..... 242/58.6 X
4,840,321 6/1989 Focke et al. ..... 242/58.6

FOREIGN PATENT DOCUMENTS 1108239 7/1965 Fed. Rep. of Germany .
3342204 5/1985 Fed. Rep. of Germany .
3501813 7/1985 Fed. Rep. of Germany .
3436217 4/1986 Fed. Rep. of Germany .
3519580 3/1987 Fed. Rep. of Germany .

*Primary Examiner*—John M. Jillions
*Attorney, Agent, or Firm*—Sughrue, Mion, Zinn, Macpeak & Seas

[57] ABSTRACT

A reel-change device for feeding high-performance packaging machines with web-like packaging material wound to form reels (11, 11*a*, 12), wherein one of two working journals (13, 14) is resupplied with a ("full") reel (11*a*), while the other working journal carries the working reel (12) which is feeding the packaging machine. The new reels (11*a*) are extracted from a reel stock (18) by means of a transport arm (21) with a transport journal (22) and are pivoted to one side or the other in order to be brought into a position equiaxial with the one working journal which has been emptied (13, 14). When there is correct alignment, the reel (11*a*) is pushed onto the empty working journal (13, 14). For this purpose, the transport art (21) is pivotable and can be shifted axis-parallel relative to the working journals (13, 14).

14 Claims, 7 Drawing Sheets

PACKAGING MACHINE, ESPECIALLY FOR CIGARETTES

DESCRIPTION

Figure 1:
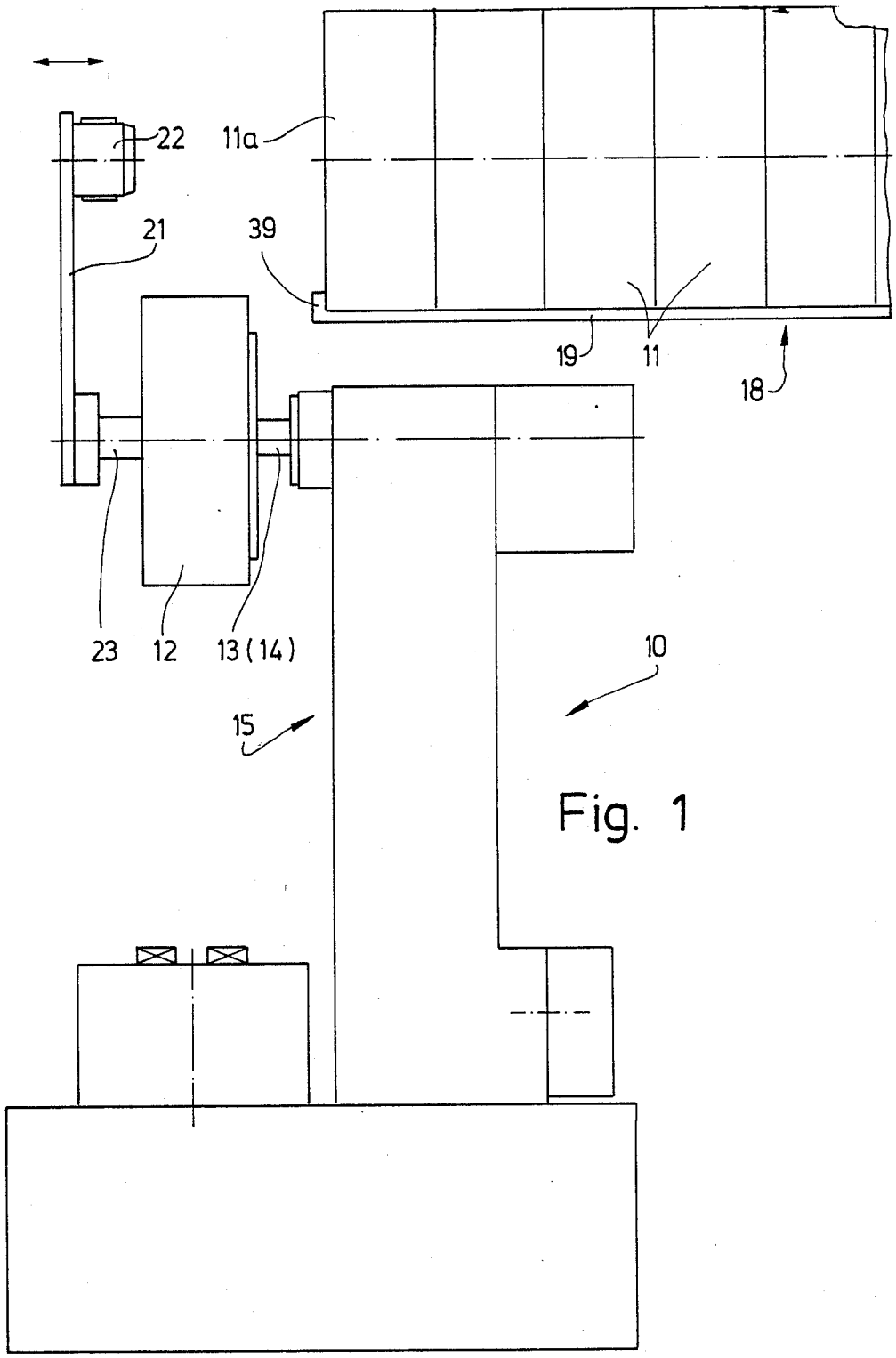

The invention relates to a packaging machine for producing (cigarette) packs from web-like packaging material which is drawn from a (working) reel situated on a working journal, a new "full" reel being extracted from a reel stock by means of a transport journal, conveyed in axial alignment in front of the working journal and transferred to this as a result of axial shifting.

Packaging machines of high performance, especially cigarette packaging machines, have a correspondingly high consumption of packaging material. This, if not supplied in the form of individual blanks produced elsewhere, is delivered to the packaging machine as a web-like material in wound reels. Blanks are then produced from these and processed within the packaging machine.

In view of the considerable consumption of packaging material, it is important to provide reels in a sufficient number and in a favourable position. Furthermore, it is important to supply new, that is to say, "full" reels to the processing station, in particular the working journal, over short conveying zones.

In a known device for feeding reels from a reel stock to a working journal, a rocker lever with a transport journal is movable along a straight conveying zone by means of a spindle mechanism. For the take-over of a reel from the reel stock and for the transfer of this to the working journal, the rocker lever, together with the reel, is pivoted transversely relative to the conveying plane (German Offenlegungsschrift 3,202,647).

Because of the linear transport of the "full" reel from the reel stock to the working journal, relatively long transport distances have to be covered, with a corresponding amount of time being taken. The efficiency of this known reel-change device is, therefore, relatively low.

The object of the present invention is, in a packaging machine for the processing of reels of web-like packaging material, to design the reel-change device so that the "empty" (working) reels can be replaced with new "full" reels within the shortest possible time, without the operation of the packaging machine thereby having to be interrupted.

In order to attain this object, according to the present invention, there is provided a reel-change device wherein a transport journal is arranged on a transport arm which is mounted pivotably between working journals and which conveys a ("full") reel along an arc of a circle alternatively in front of one of a plurality of working journals (e.g., a pair of working journals).

According to the present invention, there are two working journals, preferably arranged next to and at a distance from one another in a common horizontal plane. For producing blanks, the web-like packaging material is drawn off from either one of the two working journals. The other is ready to have its emptied reel replaced with a "full" reel. According to the invention, the latter is transferred from a reel stock by means of a transport journal mounted on a pivotable transport arm which is mounted relative to the working journals in such a way that the new reel can be conveyed in front of one or the other of the working journals as a result of short pivoting movements. The transfer conveniently takes place by hand, because the transport journal and the working journals are aligned equiaxially and only a very short conveying distance in the axial direction has to be covered.

In the preferred embodiment, the reel stock; which is in the form of a trough-shaped elongate supporting frame, is arranged above the working journals, particularly above the further constructional parts of the packaging machine, the stocked reels being placed next to and axially in line with one another. A relatively large stock can thus be provided at a spatially favourable location, without the packaging machine otherwise being obstructed. The supporting frame can easily be supplied with new reels from the rear of the packaging machine.

As a member for transferring the "full" reels from the stock to the working journals, the transport arm is mounted centrally between the transport journals, so that short pivoting movements first to one side and then the other side make it possible to feed the reels. Furthermore, the transport arm is shiftable, together with the transport journal, in its axial direction for taking over the reel from the stock set back relative to the working journals.

Figure 2:
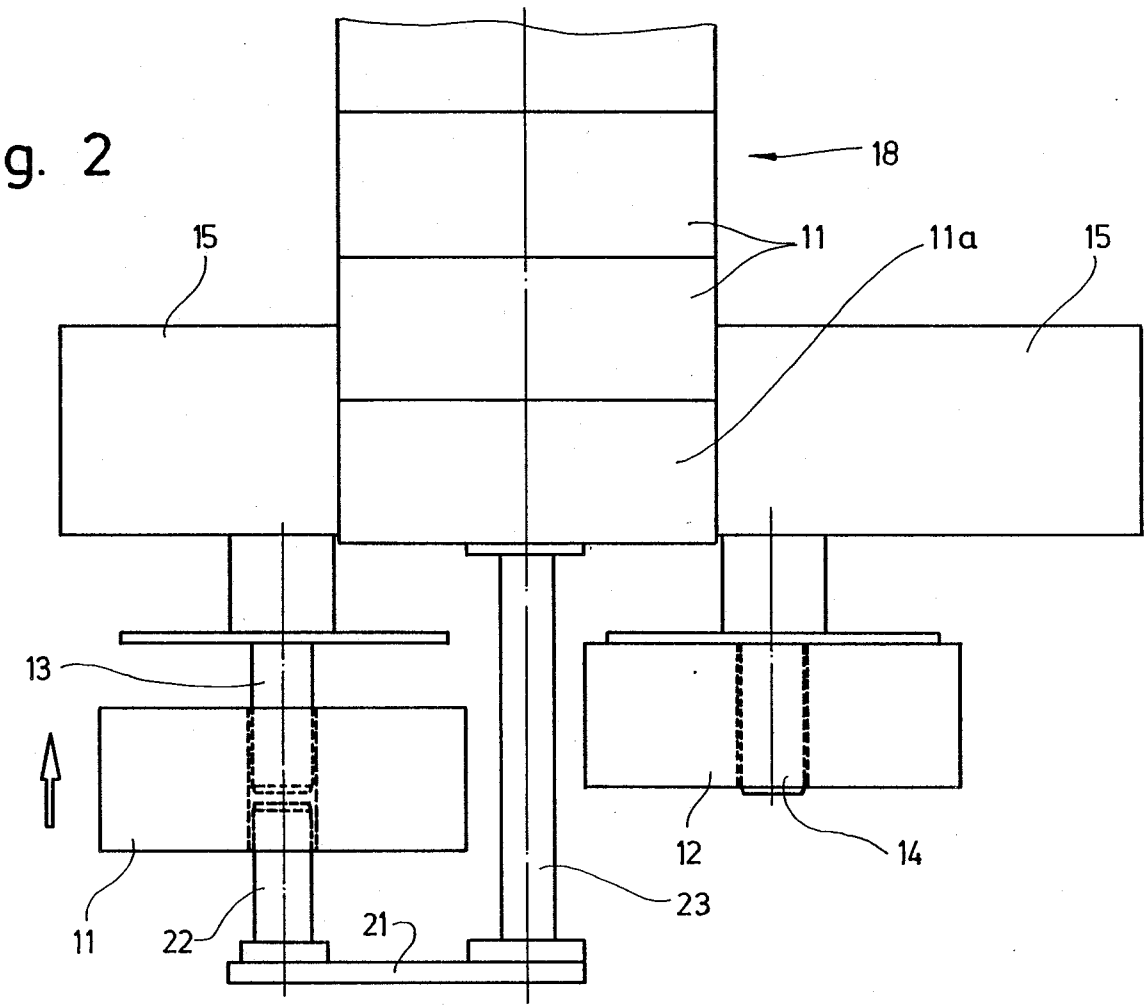
Figure 3:
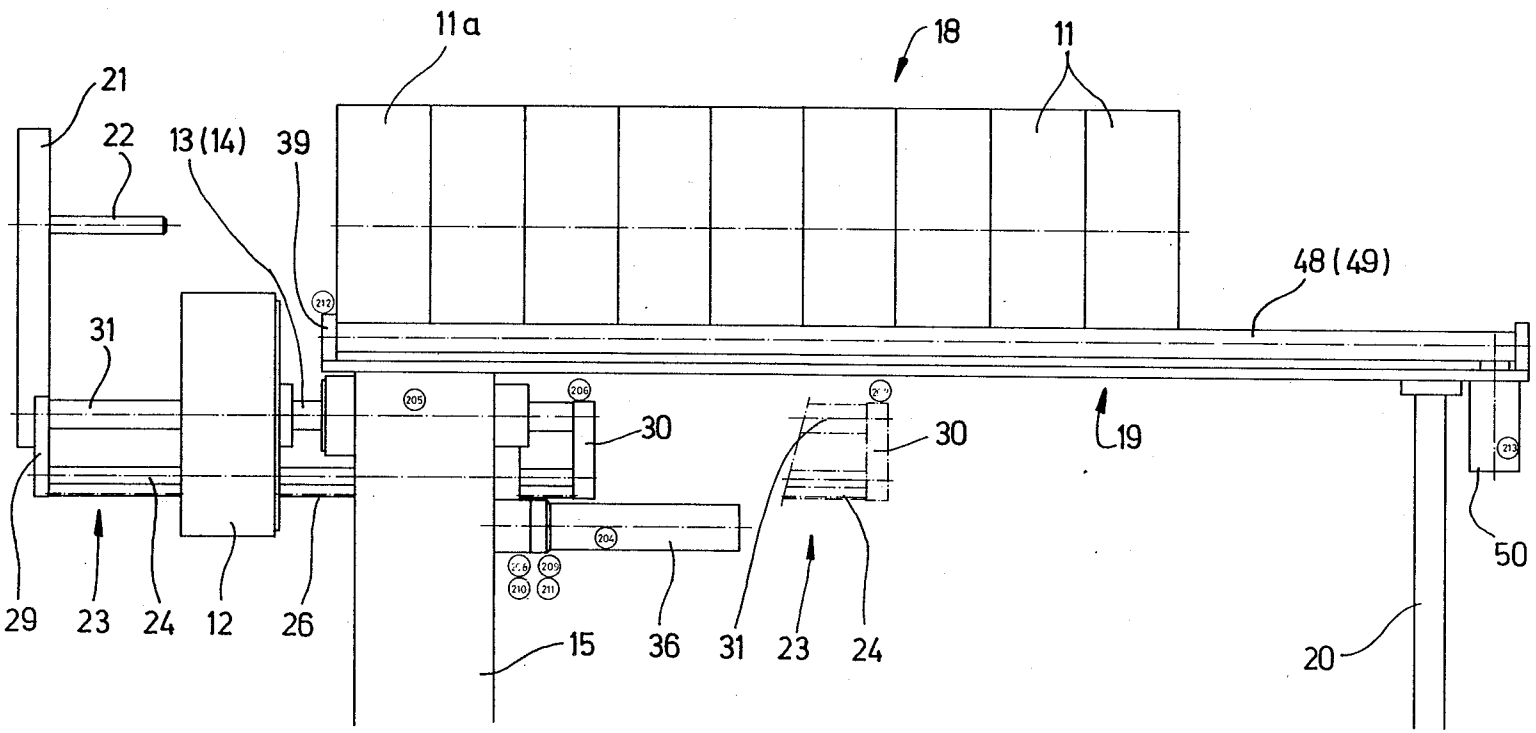
Figure 4:
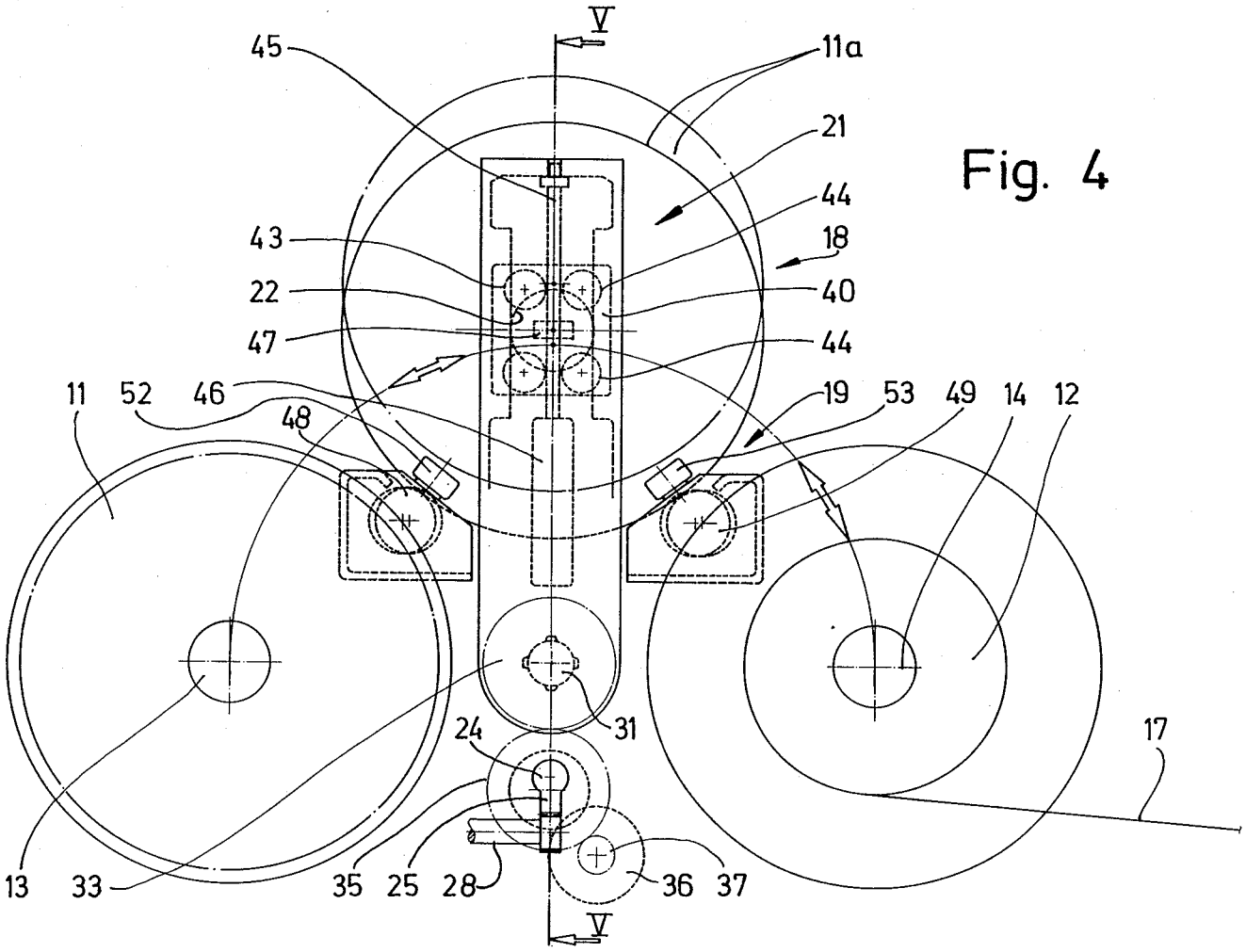
Figure 5:
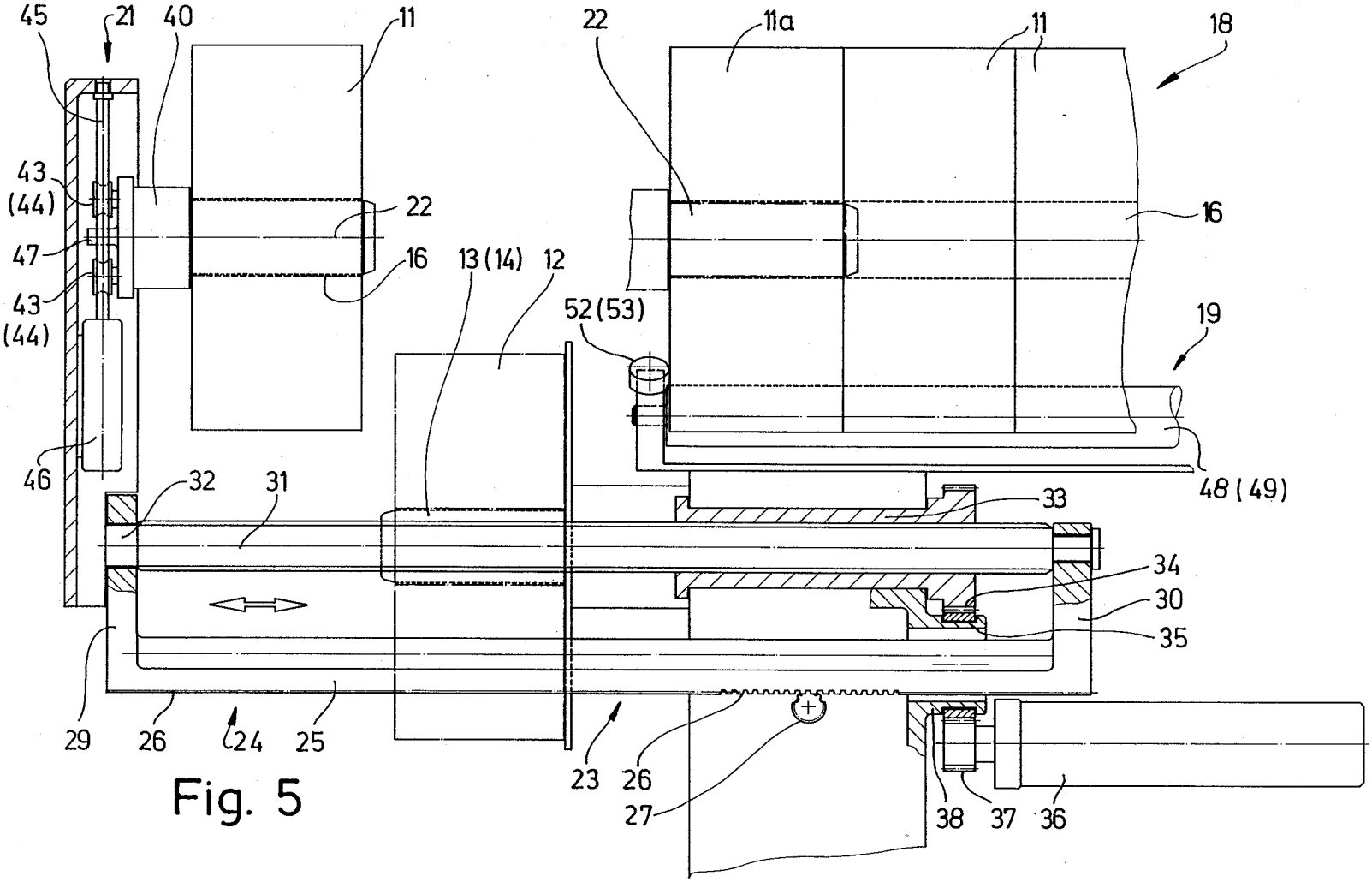
Figure 6:
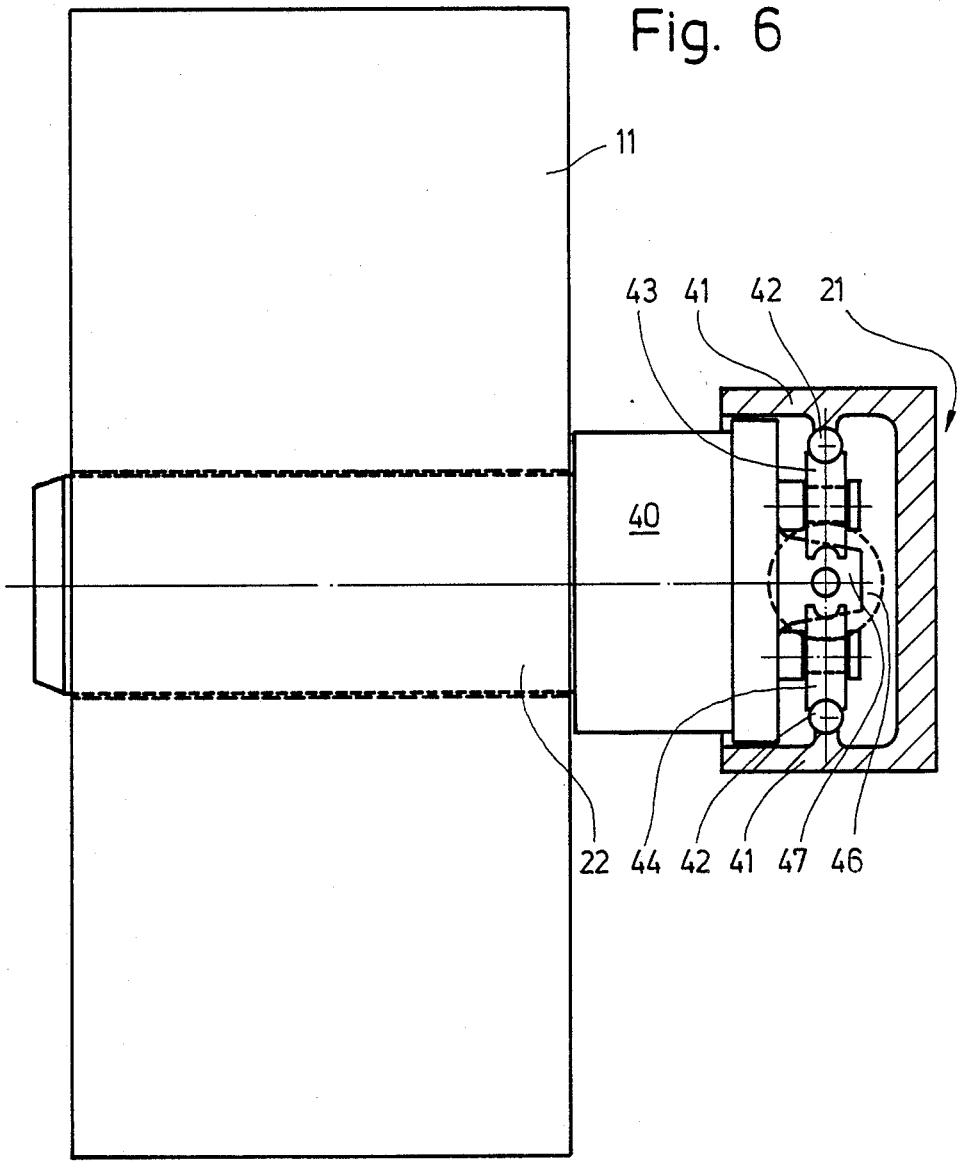
Figure 7:
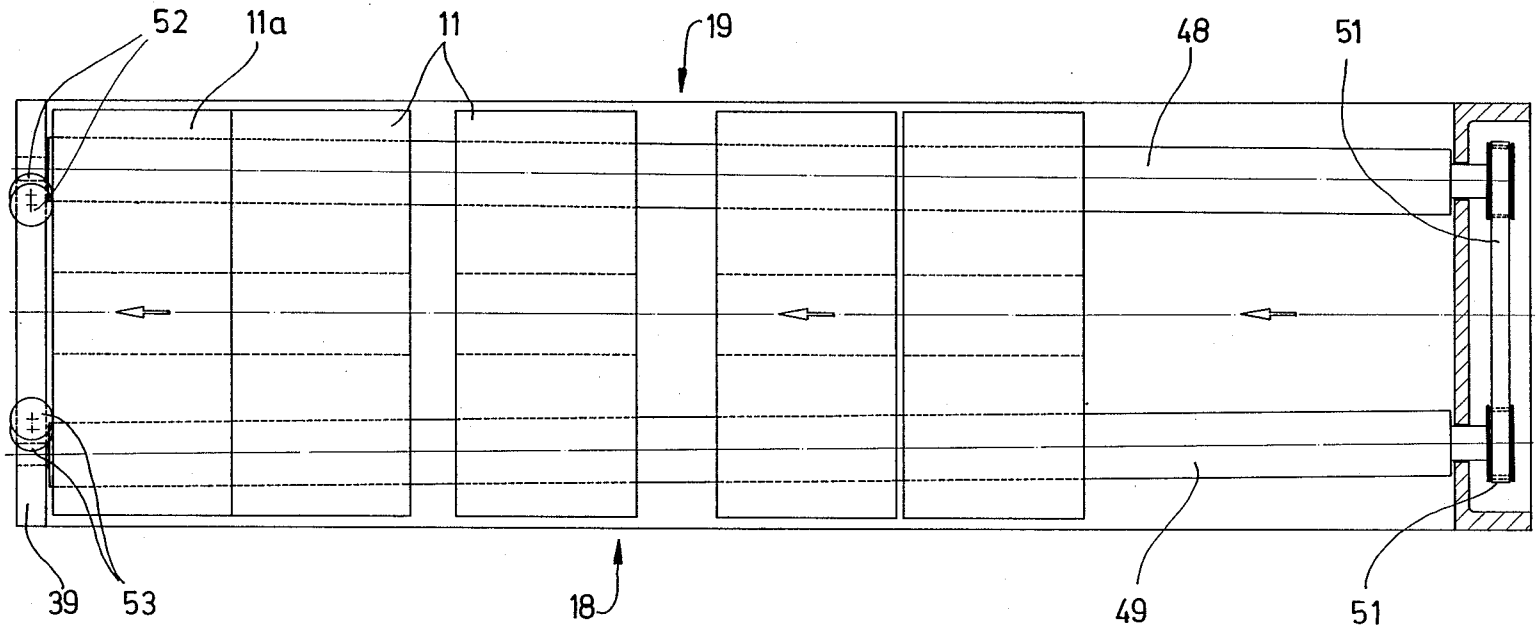

Further details of the invention relate to the construction of the transport arm and its drive and to the design of the reel stock as an elongate supporting frame. An exemplary embodiment of the device according to the invention is explained in detail below with reference to the drawings. In these:

FIG. 1 shows a greatly simplified side view of a cigarette packaging machine with a reel-change device and a reel stock, FIG. 2 shows a diagrammatic plan view of the reel-change device, FIG. 3 shows a side view of the reel-change device on an enlarged scale, FIG. 4 shows a front view of the reel-change device on a further enlarged scale, FIG. 5 shows a side view or vertical section in the plane V—V of FIG. 4, FIG. 6 shows the horizontal section through a transport arm with a plan view of a transport journal, on a further enlarged scale, FIG. 7 shows a plan view of a reel stock.

The present reel-change device is an integral component of a packaging machine 10, especially for packaging machines producing cigarette packs. Web-like packaging material, such as tinfoil, paper or plastic film, is processed by the packaging machine for this purpose. The packaging material is provided in the form of full reels 11. The web of material is drawn off from a working reel 12 and processed in order to produce blanks.

In the present exemplary embodiment, for receiving working reels 12 there are two working journals 13, 14 which are mounted at a distance from one another on a machine stand 15 in a common horizontal plane. The working journals 13, 14 are mounted on one side so as to project freely and are driven rotationally by means of members (not shown in detail) within the machine stand 15. The "full" reels 11 and working reels 12 are provided with a central hole 16 which matches the dimensions of the working journals 13, 14, so that the "full" reels 11 or working reels 12 can be pushed onto the working journals 13, 14 in the axial direction. Conventionally, the reels 11, 12 are equipped with a reel core in the form of a cardboard tube (not shown in detail) which is drawn off from the working journals 13, 14

(manually) after one of the working reels 12 has been used up. Only one of the working journals 13, 14 is in a working position at any particular time. The packaging material is drawn off from the working reel on this working journal as a web of material 17 (working journal 14 in FIG. 4), whilst the other working journal 13 is intended for receiving or keeping ready a new "full" reel 11.

Assigned to the packaging machine 10 or the reel-change device is a reel stock 18. In the present exemplary embodiment, this is arranged above the packaging machine 10 or above the machine stand 15. The reel stock 18 consists essentially of an elongate supporting frame 19 which extends horizontally transversely relative to the longitudinal extension of the packaging machine 10. The predominant part of the supporting frame 19 is at the rear of the packaging machine 10, in the exemplary embodiment according to FIG. 3, with a stay 20 at the free end. The "full" reels 11 are arranged on the supporting frame 19 in a relatively large number and in axial alignment in parallel planes, the reels 11 standing on the supporting frame 19 with their peripheral surface at the bottom. A particular "full" reel 11*a* standing at the front or located nearest to the working journals 13 is ready to be extracted and fed to one of the working journals 13, 14.

A transport arm 21 serves as a transport member for taking a "full" reel 11*a* from the reel stock 18 and for transferring it to one of the two working journals 13, 14. A freely projecting transport journal 22 mounted on one side is attached to this transport arm 21 in the upper region and likewise matches the dimensions of the central hole 16.

The transport arm 21 is mounted and driveable in a special way. The reel stock 18 is offset towards the rear of the packaging machine in relation to the vertical plane of rotation of the working reels 12. For receiving a "full" reel 11*a* from the reel stock 18, the transport arm 21 is moveable in the axial direction of the transpot journal 22, so that the transport journal, by entering the central hole 16 of the reel 11*a*, can receive the "full" reel.

The transport arm 21, together with the reel 11*a* held on the "full" transport journal 22, is moved in the opposite direction, until the reel 11*a* is in a plane in front of the working reel 12 or the working journals 13, 14. As a result of the pivoting of the transport arm 21 in this plane along an arc of a quarter circle, the reel 11*a* is moved in front of one or the other of the working journals 13, 14, specifically into alignment with this in the axial direction. In this position, the "full" reel 11*a* is transferred onto the empty working journal as a result of axial shifting, illustrated in FIG. 2 as working journal 13. The transfer conveniently takes place manually.

The transport arm 21 is now pivoted back out of the horizontally directed transfer position (FIG. 2) into the vertical middle position (FIGS. 3,4). As a result of shifting in the axial direction, the transport journal 22 is moved towards the reel stock 18 in order to take on the next reel 11*a*.

For executing the movements described, the transport arm 21 is mounted on an actuating holder 23 which is illustrated in FIG. 2 as an axially shiftable and rotatable rod. As is evident from FIGS. 3 and 5, the actuating holder 23 consists of an elongate supporting rod 24 which is mounted so as to be axially shiftable in the machine stand 15. A horizontally directed supporting rod 24 is made part-cylindrical in the upper cross-sectional region and is equipped with a lower rectangular extension 25. The latter is designed on the underside as a rack 26. This is engaged with a pinion 27 which, via a drive shaft 28 (FIG. 4), can be driven rotationally in one direction or the other by means of a motor not shown here.

The supporting rod 24 is designed at its ends with upwardly directed supporting legs 29, 30. Ends of a rotary rod 31 are mounted rotatably in these. A free bearing end 32, on the side of the machine stand 15 facing the working journals 13, 14, guided through the supporting legs 29 and connected to a lower region of the transport arm 21. Consequently, a rotational movement of the rotary rod 31 about its own longitudinal axis causes a corresponding pivoting movement of the transport arm 21 in one direction or the other.

The rotary rod 31 is mounted in a guide sleeve 33 in the machine stand 15 in an axially shiftable, but nonrotatable manner. Here, the rotary rod 31 is guided fixedly in terms of rotation in the guide sleeve 33 by means of grooves and tongues (FIG. 4).

The guide sleeve 33 is itself arranged in the machine stand 15 in a rotatable, but axially nonshiftable manner. A gear wheel 34 is arranged on an end of the guide sleeve 33 projecting from the machine stand 15. This gear wheel 34 is driven rotationally via an intermediate gear wheel 35 by a drive motor 36 with a pinion 37. The intermediate gear wheel 35 is mounted rotatably as a toothed ring on an extension 38 of the machine stand 15. The supporting rod 24 passes through the hollow extension 38. Accordingly, by means of the reversible drive of the drive motor 36, the transport arm 31 is pivoted in one direction or the other as a result of the corresponding rotary drive of the rotary rod 31. Here, this is mounted centrally between the working journals 13, 14 and at the same height as these.

A supporting frame 19 for the reel stock 18 is designed in such a way that a raised limit stop 39 is formed for the "full" reel 11*a* on the front extraction side. Therefore, the "full" reel 11*a* must first be lifted slightly before it can be taken out of the supporting frame 19. For this purpose, the transport journal 22 is mounted adjustably on the transport arm 21 so that it may be moved in the longitudinal direction of the transport arm 21. Any adjustments to different positions of the working journals 13 and 14 are also possible thereby.

In the present exemplary embodiment, the transport journal 22 is attached to a supporting body 40 which is moveable, free of tilting, along a fixed guide within the transport arm 21 open on one side and designed as a hollow body. Here, the guide consists of lateral guide rods 42 attached firmly to side walls 41. These guide rods 42 consist of round material. A plurality of supporting rollers 43, 44, mounted on the supporting body 40, rest positively with curved running faces against the guide rods 42. The supporting body 40 is equipped with four such supporting rollers 43, 44 which rest in pairs against each guide rod 42.

In order to adjust the supporting body 40 in the longitudinal direction of the transport arm 21, a spindle 45 is mounted rotatably within the latter. This is driven rotationally by means of a servo-motor 46 likewise mounted within the transport arm 21. The supporting body 40 is mounted on the spindle 45 by means of a projection serving as a spindle nut 47.

In order to extract a "full" reel 11*a* from the reel stock 18, the transport arm 21 is first moved towards the reel stock 18 until the free transport journal 22 slips into the "full" reel 11*a*. The transport journal 22 is then adjusted in the longitudinal direction of the transport arm 21, that is to say moved upwards, with the result being that the reel is lifted out of the supporting frame 19 and is thus freed. As a result of an appropriate drive of the pinion 27, the transport arm 21 is then adjusted to the pivoting plane in front of the plane of the working journals 13, 14. Then, the transport arm 21 makes the above described pivoting movement in the direction of the working journal 13, 14 to be fed. The adjusting movement of the transport journal 22 can also be carried out after the pivoting movement of the transport arm 21, so that the transport journal 22 is aligned with the axially identical position of the "empty" working journal 13, 14.

The supporting frame 19 for the reel stock 18 is likewise designed in such a way that the "full" reels 11 are conveyed continuously to the extraction end automatically and with care. For this purpose, the supporting frame 19 consists of several, in this particular case two, elongate supporting rollers 48, 49 driven rotationally. These are oriented in the longitudinal direction of the supporting frame 19 and serve as supporting and upholding members for the reels 11, 11*a*. The supporting rollers 48, 49 are directed so as to diverge slightly towards the extraction side at a very acute angle. An (equidirectional) rotary drive of the supporting rollers 48, 49 ensures that the reels 11, 11*a* delivered at the rear are always conveyed towards the limit stop 39 until they are close up against one another. For this purpose, the supporting rollers 48, 49 are driven by means of a motor 50. The ends of the supporting rollers 48, 49 facing the motor 50 are connected to one another in transmission terms by means of an enveloping drive, in the form of a toothed belt 51.

Because the supporting rollers 48, 49 cause the "full" reels 11, 11*a* to constantly rotate, inwardly projecting back-up rollers 52, 53 are mounted on the limit stop 39 of the supporting frame 19 in order to prevent mechanical stress from being exerted on the free front face of the reel 11*a*. These back-up rollers 52, 53 are mounted with inclined axes, so that they co-rotate in a frictionless manner according to the rotary movement of the reel 11*a* and thus prevent rubbing marks etc. on the packaging material.

What is claimed is:

1. Packaging machine for producing cigarette packs from web-like packaging material which is drawn from a working reel on one of a plurality of working journals, a new "full" reel being extracted from a reel stock by means of a transport journal, conveyed in axial alignment in front of an empty one of said working journals and transferred to said empty working journal as a result of axial shifting, characterized in that said transport journal (22) is disposed on a transport arm (21) which is mounted pivotably between said working journals (13, 14), and which conveys said "full" reel (11*a*) along an arc of a circle alternatively in front of an empty one of said working journals (13, 14).

2. Device according to claim 1, wherein said transport journal (21) is axially shiftable, as a result of an axially shiftable arrangement of said transport arm (21).

3. Device according to claim 1 or 2, wherein a pivot bearing of a rotary rod attached to said transport arm (21) is arranged centrally between said working journals (13, 14), in the same horizontal plane as said working journals.

4. Device according to claim 1 or 2, wherein said transport journal (22) is shiftable transversely axially, in the longitudinal direction of said transport arm (21).

5. Device according to claim 4, wherein the transport journal (22) is mounted shiftably on said transport arm (21) by means of a tiltproof guide and is moveable in the longitudinal direction of said transport arm (21) via a servo-motor (46) attached to said transport arm (21).

6. Device according to claim 5, wherein a supporting body of said transport journal (22) is moveable by means of a plurality of supporting members, said supporting members comprising supporting rollers (43, 44), on a plurality of fixed guides comprising guide rods (42) on said transport arm (21) and moved by a mechanical gear in the form of a spindle mechanism (45, 47).

7. Device according to claim 1, wherein said transport arm (21) is mounted on an actuating holder (23) which is shiftable axis-parallel to said working journals (13, 14) by means of a mechanical drive.

8. Device according to claim 7, wherein said actuating holder (23) is equipped with a rack (26) which extends axis-parallel relative to said working journals (13, 14) and which is driven via a fixed feed motor with a pinion (27) in order to adjust said transport arm (21) transversely relative to its pivoting plane.

9. Device according to claim 7, wherein mounted rotatably on said actuating holder (23) is an elongate rotary rod (31) which transmits pivoting movements to said transport arm (21), and which is driven rotationally via a plurality of gear wheels (37, 35, 34) by means of a drive motor (36), and which is shiftable in the longitudinal direction together with said transport arm (21).

10. Device according to claim 9, wherein said rotary rod (31) is mounted in a nonrotatable, but axially shiftable manner in a rotatably mounted guide sleeve (33) fixed in place, the free end of which is one of said plurality of gear wheels (34) which are driven by means of said drive motor (36).

11. Device according to claim 1, wherein said reel stock (18) is arranged above said working journals (13, 14), specifically in a vertical mid-plane between said working journals (13, 14), and within said reel stock (18) said "full" reels (11, 11*a*) are arranged equiaxially next to one another in a position parallel to the axes of said working journals (13, 14).

12. Device according to claim 10, wherein within said reel stock (18), said "full" reels (11, 11*a*) rest with their peripheral surfaces on a supporting frame (19), by means of which said "full" reels (11, 11*a*) are conveyed continuously in the direction of an extraction position facing said working journals (13, 14).

13. Device according to claim 12, wherein said "full" reels (11, 11*a*) rest with their peripheral surfaces on two supporting rollers (48, 49) which extend in the longitudinal direction of said supporting frame (19) and which are driven equidirectionally and rotationally, said supporting rollers (48, 49) extending so as to diverge slightly in the direction of the extraction side of said "full" reels (11, 11*a*).

14. Device according to claim 12, wherein a front one of said "full" reels (11*a*) facing the extraction side is supported laterally within said reel stock (18) by rolling members, said members comprising back-up rollers (52, 53).

* * * * *